United States Patent [19]

Kaneko et al.

[11] 4,131,531

[45] Dec. 26, 1978

[54] APPARATUS FOR STRIPPING ELECTRODEPOSITED METAL FROM CATHODE SHEETS

[75] Inventors: Koichi Kaneko; Kiyotaka Abe; Masakazu Miura, all of Akita, Japan

[73] Assignee: Mitsubishi Kinzoku Kabushiki Kaisha, Tokyo, Japan

[21] Appl. No.: 811,447

[22] Filed: Jun. 29, 1977

[51] Int. Cl.[2] ..... C25C 7/08

[52] U.S. Cl. ..... 204/208; 204/198; 204/222; 83/132; 156/584; 164/401

[58] Field of Search ..... 204/198, 208, 222, 224 R, 204/224 M; 83/129, 132; 156/584; 164/401

[56] References Cited

U.S. PATENT DOCUMENTS

| | | | |
|---|---|---|---|
| 1,864,490 | 6/1932 | Harrison | 204/208 |
| 3,332,128 | 7/1967 | Mori | 204/208 X |
| 3,619,400 | 11/1971 | Eisner | 204/208 X |
| 3,625,806 | 12/1971 | Wennberg | 156/584 |

*Primary Examiner*—Arthur C. Prescott
*Attorney, Agent, or Firm*—Wenderoth, Lind & Ponack

[57] ABSTRACT

For stripping or peeling electrorefined or otherwise purified metal, which have been deposited on a set of cathode sheets, off the opposite faces of the sheets, these sheets are transported from an electrolytic cell into a rack and are therein held in side-by-side relationship with preassigned spacings therebetween. A plurality of stripper assemblies each comprising a pair of stripper plates normally held in face-to-face relationship with each other are disposed in coplanar relationship to respective cathode sheets within the rack and are moved into and out of the rack. When each stripper assembly is moved into the rack, as by a hydraulic cylinder, its pair of stripper plates slide over the opposite faces of the corresponding one of the cathode sheets thereby peeling off the high-purity metal.

17 Claims, 18 Drawing Figures

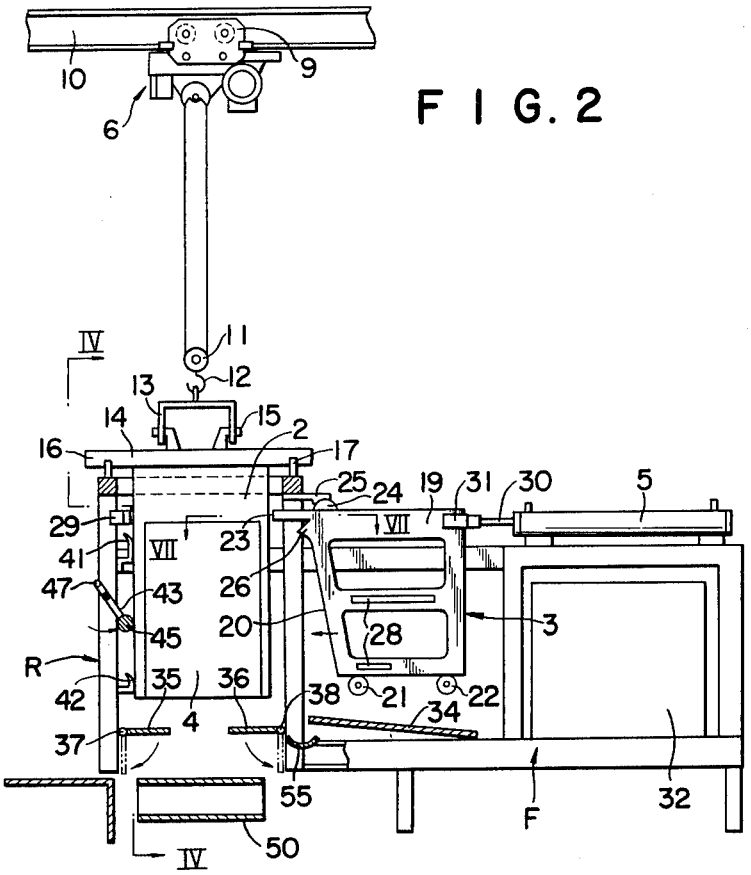
FIG. 2
FIG. 4
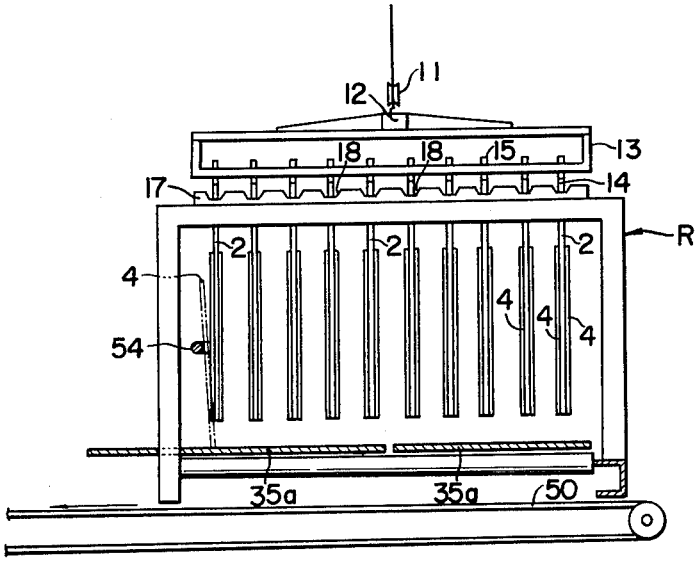

APPARATUS FOR STRIPPING ELECTRODEPOSITED METAL FROM CATHODE SHEETS

BACKGROUND OF THE INVENTION

This invention relates to apparatus for stripping high-purity metal from cathode sheets on the opposite faces of which the metal has been deposited in sheet form by electrometallurgical processes such as electrorefining and electrowinning.

With a view to curtailment of human labor and increase in production, a variety of apparatus have been suggested and used for stripping high-purity metal layers deposited on the faces of a set of cathode sheets in an electrolytic cell. Typical of such known apparatus is the one utilizing a conveyor for receiving a set of cathode sheets as the same is hoisted out of a cell after the electrodeposition of desired metal thereon and for transporting the cathode sheet set to a stripping mechanism. After the metal layers have been removed, the cathode sheet set is reloaded on the conveyor, transported back to the electrolytic cell, and again placed therein by the hoisting mechanism.

The prior art apparatus thus requires a highly involved procedure of operational steps, necessitating the elapse of an undue length of time from the withdrawal of the used cathode sheets from the electrolytic cell to the replacement of the reconditioned sheets into the cell. As an additional problem, the stripping mechanism itself of the prior art apparatus is capable of handling only one or two cathode sheets at one time.

A typical known stripping mechanism is shown and described in Japanese Patent Application Laying-Open No. 49-79327 (79327/1974). In this stripping mechanism, a single cathode sheet with electrodeposited metal layers on the opposite faces thereof is suspended vertically, and a pair of parallel horizontal stripper rods are moved horizontally relative to the sheet in a manner such that an upper part of the sheet without the metal layers deposited is pinched between the rods. Thereafter, the sheet is lifted relative to the stripper rods so that the rods first engage the upper edges of the metal layers and then peel the layers off the sheet as the sheet is moved upward.

It is apparent that this mechanism cannot be said to be efficient because the two steps of relative movement between the stripper rods and the cathode sheet in different directions are necessary and because the stripping operation must be carried out sheet by sheet.

SUMMMARY OF THE INVENTION

It is an object of this invention to provide improved apparatus capable of simultaneously stripping electrodeposited high-purity metal from a set of cathode sheets, so constructed and arranged that the production rate of such metal can be markedly increased.

Another object of the invention is to provide apparatus of the above character which operates reliably to strip or peel electrodeposited high-purity metal off the faces of a set of cathode sheets by a single stroke of a set of stripper assemblies and which requires little attention from an operator during the stripping operation.

A further object of the invention is to provide apparatus of the above character which may be installed in a processing plant without major alteration of the plant, and which occupies a relatively small floor space.

With these and other objects in view, this invention is directed, in brief, to the provision of apparatus including rack means for holding therein a plurality of cathode sheets, from which desired high-purity metal layers are to be stripped, in side-by-side relationship with specific spacings therebetween, a plurality of stripper assemblies each comprising a pair of stripper plates disposed in face-to-face arrangement with respect to each other and substantially in coplanar relationship to a respective one of the cathode sheets held in position within the rack means, said stripper assemblies being movable along the planes of the respective cathode sheets between a first position confronting an open side of the rack means and a second position within the rack means, and means for moving the stripper assemblies between the first and the second positions, whereby upon movement of the stripper assemblies from the first to the second position, each of the pair of stripper plates slide over the opposite faces of one of the cathode sheets thereby peeling off the high-purity metal layers.

Preferably, the stripper plates are made of relatively rigid by suitably resilient material, and each pair of stripper plates are held in substantial contact with each other when in the first position. Each pair of stripper plates can be formed with a pair of divergent lips projecting forwardly and outwardly therefrom, in order that the respective one of the stripper sheets will be positively caught therebetween through the lips as the stripper plates start travelling from the first toward the second position.

According to another feature of the invention, the stripper plates are further formed with blade portions at their front ends. Held in sliding contact with the opposite faces of one of the stripping sheets, the blade portions of each stripper assembly facilitate the peeling of the high-purity metal layers away from the sheet.

A suitable hoisting and transporting mechanism can be employed for the transfer of the set of cathode sheets from an electrolytic cell, in which the metal layers are deposited thereon by electrolysis, into the rack. Following the removal of the metal layers from their opposite faces in the above described manner, the complete set of cathode sheets is returned by the same mechanism to the cell for repeated use. Advantageously, the set of cathode sheets can be held suspended from the hoisting and transporting mechanism throughout the course of the above procedure.

The above and other objects, features and advantages of this invention and the manner of attaining them will become more apparent, and the invention itself will best be understood, from the following detailed description and appended claims, taken togeher with the accompanying drawings showing a preferred embodiment of the invention.

BRIEF DESCRIPTION OF THE DRAWINGS

FIG. 2 is a similar schematic elevational view of the main part of the apparatus, but showing a different operational stage;

FIG. 4 is a vertical section taken along the line IV—IV in FIG. 2 and showing the rack of the apparatus together with a set of cathode sheets held in position therein;

DESCRIPTION OF THE PREFERRED EMBODIMENT

Figure 1:
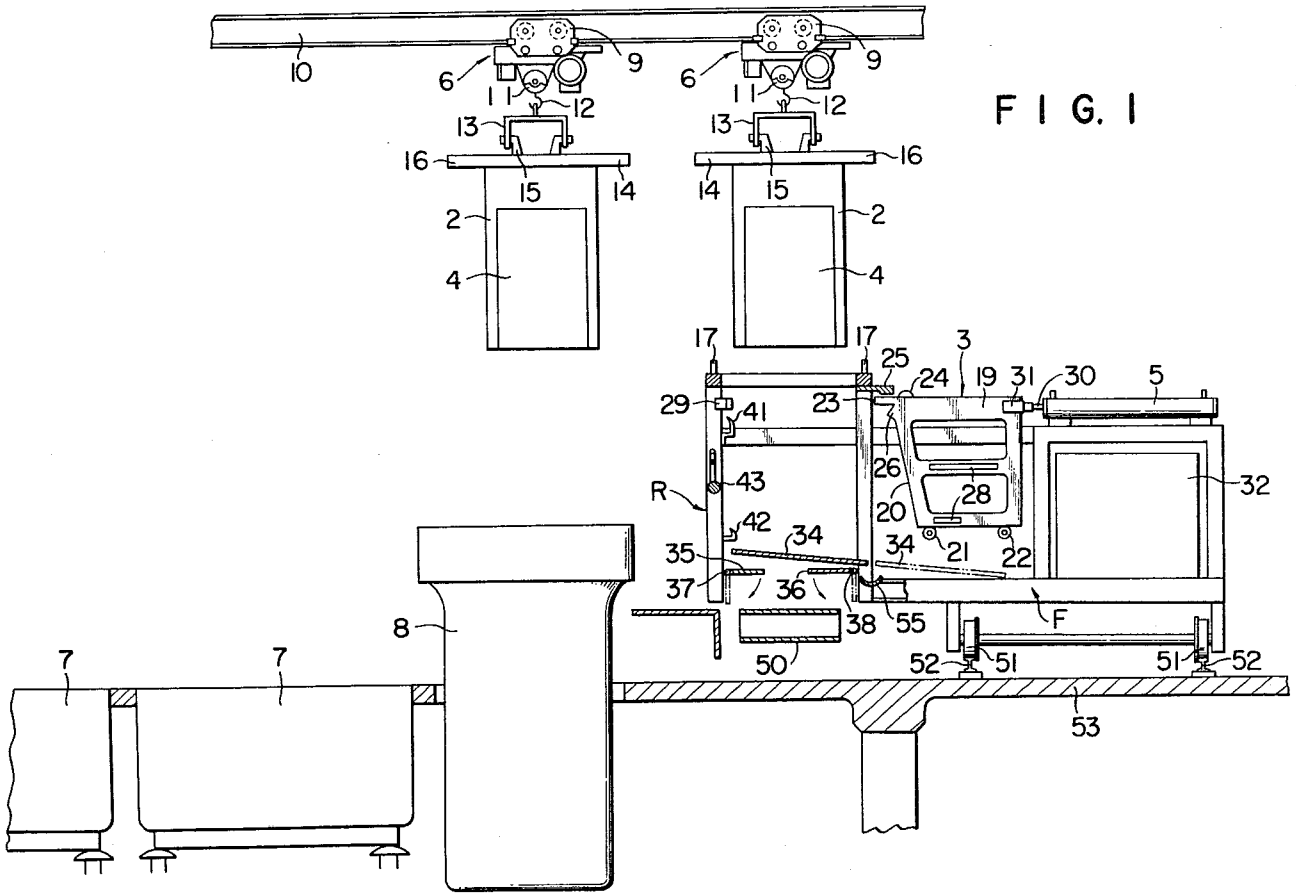
FIG. 1 is a schematic elevational view, with parts cut away and parts in vertical section, showing the essential arrangement and construction of one example of the apparatus in accordance with this invention.

Referring now to the drawings and in particular to FIGS. 1 through 4 thereof, the preferred form of the apparatus in accorcance with this invention comprises a rack R for holding therein a set of cathode sheets 2 in side-by-side relationship with predetermined constant spacings therebetween as most clearly shown in FIGS. 2 and 4, a plurality of strippers assemblies 3 movable into and out of the rack R for stripping high-purity metal layers 4 from the opposite faces of each cathode sheet 2, and a plurality of fluid-actuated cylinders 5 for moving the stripper assemblies 3 into and out of the rack R.

The reference numeral 6 in FIG. 1 generally designates a hoisting and transporting mechanism for lifting the set of cathode sheets 2 from an electrolytic cell 7 after the metal layers 4 have been electrolytically deposited thereon to a desired thickness and for transporting and lowering the cathode sheet set into the rack R. The reference numeral 8 designates a rinsing tank in which the set of the cathode sheets 2 are rinsed before they are placed in the rack R. The hoisting and transporting mechanism 6 comprises a trolley 9 capable of running on an overhead track 10 by being self-propelled. The trolley 9 is equipped with one or more tackle arrangements 11, complete with a drive mechanism, for lifting and lowering the set of cathode sheets 2 via hooks 12 and a common hanger 13.

Each cathode sheet 2 is suspended from a bar 14 which has a pair of hooks 15 projecting upwardly therefrom for engagement with the hanger 13. The complete set of cathode sheets 2 can thus be hung on the hanger 13 in spaced-apart, side-by-side relationship. The bar 14 of each cathode sheet also provides a pair of lugs 16 projecting beyond the lateral edges of the sheet.

The rack R is of generally box-like configuration and has an open top and at least one open side, the latter being shown directed toward the right in FIG. 1. The rack R has a pair of elongate transverse members 17 on opposite front and rear rims of its open top, and these members have each a series of constantly spaced notches 18 formed therein, as most clearly shown in FIGS. 2 and 3, for engagement with the lugs 16 of the starting sheets. Thus, as the set of cathode sheets 2 is lowered into the rack R through its open top by the hoisting and transporting mechanism 6, the lugs 16 are engaged in the notches 18 of the members 17, so that the cathode sheets are held within the rack R in vertical disposition with the desired constant spacings therebetween.

Figure 3:
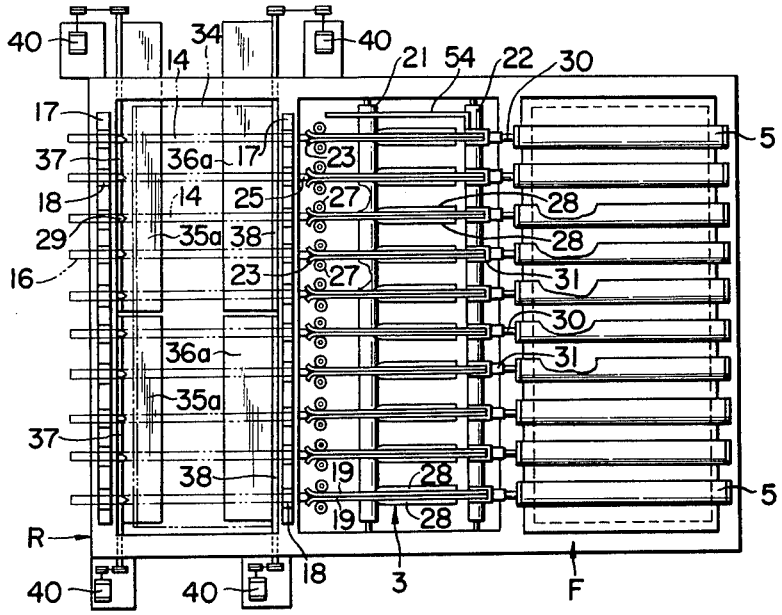
FIG. 3 is a top plan view showing the main part of the apparatus of FIG. 1 except its hoisting and transporting mechanism.

The stripper assemblies 3 are all of identical construction, and one stripper assembly is provided for each cathode sheet 2. Each stripper assembly comprises a pair of opposed stripper plates 19 of relatively rigid but suitably resilient material which, when the assembly is in the position shown in FIGS. 1 and 3, are disposed substantially in face-to-face contact with each other. The contacting faces of each paired stripper plates 19 are in coplanar relationship to the associated cathode sheet 2 held in position within the rack R. These stripper plates are quadrilateral in shape, having sloping front edges 20.

Resting on a pair of guide rollers 21 and 22 rotatably supported by a framework F fixedly supporting the rack R, the stripper assemblies 3 are movable between a first position confronting the open side of the rack R (FIGS. 1 and 3) and a second position within the rack along the planes of the respective cathode sheets 2 held in position within the rack. Each stripper assembly 3 has a pair of spread-apart lips 23 projecting forward (leftwardly as viewed in FIG. 1) from the top ends of the respective stripper plates 19 in order that one of the cathode sheets 2 may be unfailingly caught between the pair of stripper plates as the assembly starts travelling from the first toward the second position.

Figure 5:
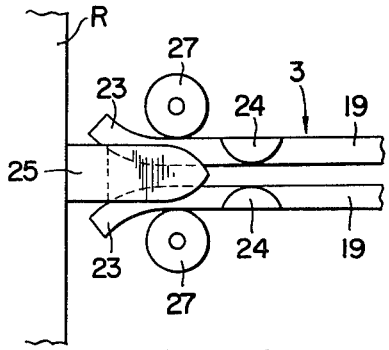
FIg. 5 is a fragmentary plan view, on a relatively enlarged scale, showing a first spreader cam, projections on a stripper assembly, and squeeze rolls.

On the top edges of the stripper plates 19, there are provided opposed projections 24 which are most clearly shown in FIG. 5. These projections 24 engage and cooperate with a wedge-shaped first spreader cam 25 fixedly secured to the rack R, as the stripper assembly 3 advances from the first position, as will be described later in detail.

Each stripper plate 19 is further formed with a sharp-edged blade portion 26 located immediately under the lip 23. This blade portion, shown to be triangulated in FIG. 1, also projects forward from each stripper plate 19 and terminates short of the lip 23. As shown in FIGS. 3 and 5, a pair of upright squeeze rolls 27 are disposed on opposite sides of each stripper assembly 3, adjacent to the rack R, so as to press the pair of stripper plates 19 against or toward each other. These rolls 27 are suitably supported by the framework F by intermediary of resiliently yieldable suspension means not shown.

After one of the cathode sheets 2 is caught between each pair of stripper plates 19 by their lips 23, the stripper blade portions 26 are therefore urged against the opposite faces of the cathode sheet and slide thereover to partly shave or peel the high-purity metal layer 4 away therefrom. The stripper plates 19 are additionally provided with ridges 28 or like protuberances on their outer sides for facilitating the separation of the high-purity metal layer 4 from the cathode sheets.

As shown in FIGS. 1 and 3, a wedge-shaped second spreader cam 29 similar to the first cam 25 is securely supported by the rack R so as to act on the pair of lips 23 of each stripper assembly 3 when the latter reaches the aforesaid second position within the rack. When caught between the lips 23, the cam 29 causes the pair of plates 19 of each stripper assembly to move away from each other, out of contact with the opposite faces of the associated cathode sheet 2. The cathode sheets can therefore be freed from the stripper assembly 3 immediately upon complete stripping of the high-purity metal layer 4 therefrom.

It will be seen from FIGS. 1 and 3 than the fluid-actuated cylinders 5 are fixedly mounted in side-by-side arrangement on the framework F. The piston rod 30 of each cylinder 5 is rigidly connected to the associated stripper assembly 3 via a clamp 31. Preferably, these cylinders are of the hydraulic type, having opposed fluid chambers communicating with a source of pressurized hydraulic fluid via suitable piping and valving. The pressurized fluid source and other means necessary for the operation of the hydraulic cylinders 5 can be mounted at 32 in the framework F.

As shown in FIG. 1, a drip receiving panel 34 is provided in the rack R. The panel 34 is disposed near the lower end of the rack and is slidingly movable between a drip receiving position shown in solid line and a retracted position shown by the chain line.

Below the panel 34 there are provided cathode sheet supporting plates 35 and 36 which are disposed in opposed relationship as shown. These plates are lined with a cushioning material such as rubber and are normally in horizontal position to receive thereon the high-purity metal layers 4 which are stripped from the cathode sheets 2 conveyed into the rack as shown in FIG. 2. The supporting plate 35 may be divided into a pair of plates 35*a* (FIG. 3) which are pivotable around pivot shafts 37. Likewise, the supporting plate 36 may be divided into a pair of plates 36*a* which are pivotable around pivot shafts 38. The pivot shafts 37 and 38 are connected to actuators 40 through appropriate linkages, respectively, so thst the supporting plates 35*a* and 36*a* can be swung around the pivot shafts 37 and 38 from the horizontal positions to the vertically suspended positions shown by imaginary lines by operating the actuators 40.

The rack R comprises positioning members 41 each fixed thereto to precisely position the associated cathode sheet 2 which is lowered into the rack. The positioning members 41 are disposed at a relatively high part of the rack R.

The rack R further comprises guide members 42 fixedly secured thereto immediately above the supporting plate 35. These guide members 42 serve to guide the stripped high-purity metal layers or sheets 4 when they are to be tumbled as will be described hereinafter.

Figure 6:
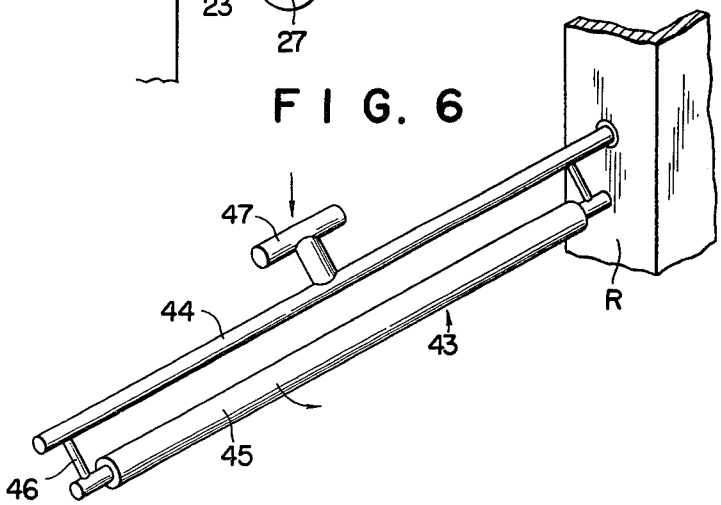
FIG. 6 is a perspective view showing a device for preventing vibration of cathode sheets.

Between the positioning members 41 and the guide members 42, there is provided a device 43 for preventing vibration of the cathode sheets 2 which occurs when the bars 14 of the sheets have just been placed on the elongate members 17. As shown in FIG. 6, the device 43 comprises a horizontal turnable shaft 44 pivotally supported by the rack R, a roll 45 made of a resilient material such as rubber and secured to the shaft 44 in parallelism thereto by means of connecting rods 46, and a handle 47. When the handle 47 is depressed as shown by the arrow immediately after the bars 14 of the cathode sheets 2 have been placed on the elongate members 17, the roll 45 is caused to engage the side edges of the sheets 2 as shown in FIG. 2 to stop the vibration of the sheets instantly.

A conveyor 50 for conveying the stripped or peeled high-purity metal sheets 4 away from the apparatus is installed below the rack R. The conveyor 50 extends in a direction transverse to the direction of the movement of the stripper assemblies 3 as shown in FIG. 4. The peeled metal sheets 4 drop onto the conveyor 50 when the supporting plates 35 and 36 are swung down as will be described in more detail hereinafter.

The rack R and the framework F form a single rigid structure, which is movable in a direction transverse to the direction of movement of the stripper assemblies 3 by means of wheels 51 on rails 52 laid out on a floor 53 as shown in FIG. 1. This enables the rack and framework to move to any position at which they are aligned with other electrolytic cells end rinsing tanks not shown.

The operation of the above described apparatus will now be described.

Within the electrolytic cell 7, the desired high-purity metal layers 4 is electrolytically deposited in sheet form on both faces of each cathode sheet 2 in the well known manner. After the metal deposits on the sheets 2 have grown to a desired thickness, the complete set of cathode sheets is lifted from the cell 7, transported, and lowered into the rinsing tank 8 by the hoisting and transporting mechanism 6. After rinsing, the set is again lifted, transported and lowered into the rack R.

While the set of the cathode sheets 2 is being lowered toward the rack R, the drip receiving panel 34 is in the drip receiving position shown in FIG. 1, so that the rinsing liquid dripping down from the set into the rack is received by the panel and flows down into a trough 55 to flow away rom the apparatus, whereby the supporting plates 35 and 36, the conveyors 50 and so on are prevented from becoming wet.

After the set of the cathode sheets 2 has been brought down into the position shown in FIG. 2 wherein the bars 14 thereof rest on the elongate members 17, the panel 34 is moved to the retracted position. The sheet positioning members 41 serve to precisely locate all the cathode sheets relative to the rack R, and when the handle 47 of the device 43 is depressed, the roll 45 engages the sheets 2 to stop the vibration thereof caused by the impact of the bars 14 thereof against the elongate members 17. The set of the sheets 2 are thus held by the rack in respective coplanar relationships to the stripper assemblies 3.

Figure 7:
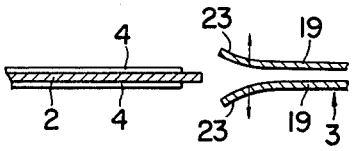
FIG. 7 is a fragmentary plan view showing a cathode sheet and a pair of lips of the stripper assembly.

The hydraulic cylinders 5 are then actuated to cause extension of their piston rods 30. With the consequent forward motion of the stripper assemblies 3 from the first toward the second position, the projections 24 on the upper edges of each stripper assembly 3 first engage and are acted upon by the associated first spreader cam 25 as shown in FIG. 2, whereby the pair of lips 23 of the assembly is moved apart from each other as shown in FIG. 7 to facilitate the advance of the assembly without any interference with the sheet 2. After the projections 24 have passed through the extent of the cam 25, the lips 23 move toward each other so that the cathode sheet 2 is first caught between the lips 23. The movement of lips 23 toward each other is caused by the resiliency of the stripper plates 19 and by the action of the squeeze rolls 27. It will be noted that, with each cathode sheet 2 thus caught between the pair of stripper plates 19, the pair of squeeze rolls 27 function to urge the plates, particularly their blade portions 26, against the respective opposite faces of the cathode sheet 2.

Figure 8:
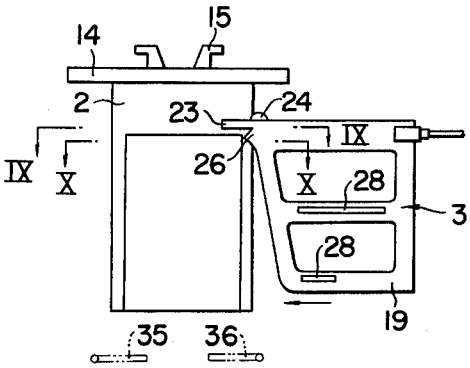
FIG. 8 is a partial elevational view of one of the cathode sheets and the associated stripper assembly, with the latter being shown slightly moved toward the former to start stripping the high-purity metal layers off the opposite faces of the sheet.
Figure 9:
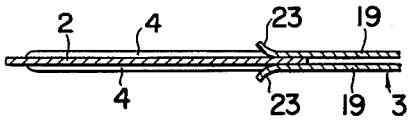
FIG. 9 is a horizontal section taken along the line IX—IX in FIG. 8 and showing in particular the pair of lips of the stripper assembly.
Figure 10:
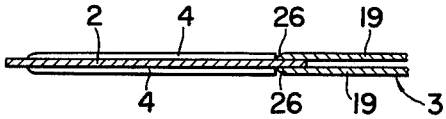
FIG. 10 is a horizontal section taken along the line X—X in FIG. 8 and showing in particular blade portions of the stripper assembly.

As the stripper assemblies 3 advance to the position shown FIG. 8, the stripper blade portions 26 of each assembly abut the side edges of the deposited metal layers 4 as shown in FIG. 10 with the lips 23 held against the opposite faces of the cathode sheet 2 as illustrated in FIG. 9.

Figure 11:
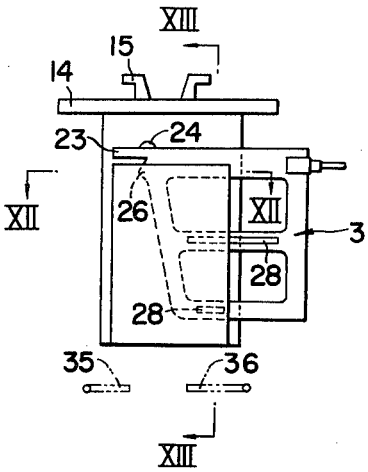
FIG. 11 is a view similar to FIG. 8 but showing the stripper assembly further moved forward and the high-purity metal layers partly separated from the cathode sheet.
Figure 12:
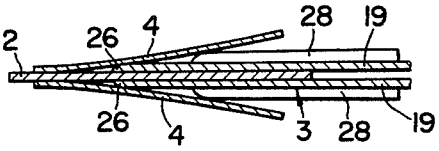
FIG. 12 is a horizontal section taken along the line XII—XII in FIG. 11.
Figure 13:
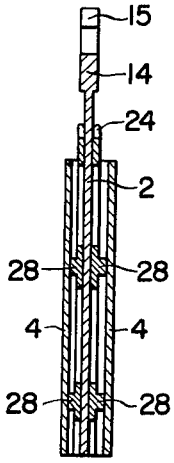
FIG. 13 is a vertical section taken along the line XIII—XIII in FIG. 11.

As illustrated in FIG. 11, with the continued forward motion of the stripper assemblies 3, the pairs of stripper blade portions 26 slide over the opposite faces of the cathode sheets 2 to partly strip or peel the high-purity metal layers 4 away from the sheets. It will be noted from FIGS. 12 and 13 that the pairs of stripper plates 19 together with the ridges 28 function to gradually separate the high-purity metal layers 4 from the cathode sheets 2.

Figure 14:
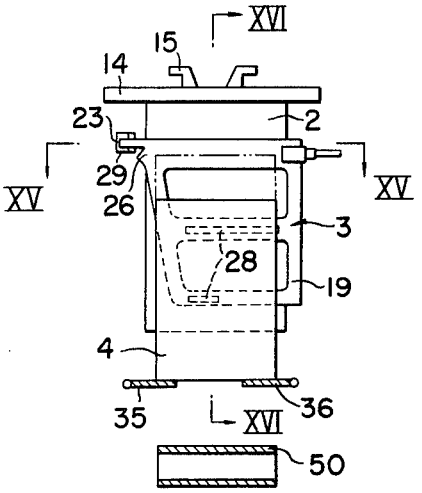
FIG. 14 is a view similar to FIG. 8 but showing the stripper assembly moved substantially fully forward and the high-purity metal layers thoroughly peeled off the cathode sheet.
Figure 16:
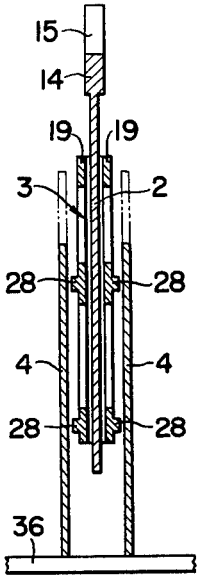
FIG. 16 is a vertical section taken along the line XVI—XVI in FIG. 14.
Figure 15:
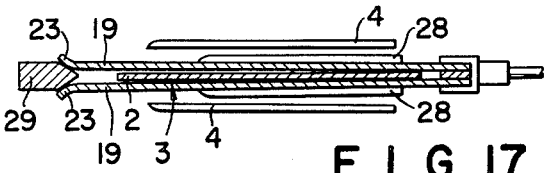
FIG. 15 is a horizontal section taken along the line XV—XV in FIG. 14 and showing in particular the high-purity metal layers separated from the opposite faces of the cathode sheet.

When the stripper assemblies 3 reach the second position within the rack R, as shown in FIG. 14, the high-purity metal layers 4 are thoroughly stripped from the cathode sheets as illustrated in FIGS. 15 and 16. It will be noted that the stripped metal layers of sheets 4 drop onto, and are held upright on, the supporting plates 35 and 36. In this second position, as clearly seen in FIG. 15, the second spreader cam 29 acts on the associated pair of lips 23 to move them apart from each other, whereby the pair of stripper plates 19 are forced away from each other and hence out of contact with the opposite faces of the associated cathode sheet 2 to facilitate lifting of the sheet.

The complete set of the cathode sheets 2 are then lifted from within the rack R by the hoisting and transporting mechanism 6, leaving behind the stripper assemblies 3, and are transported and lowered into the electrolytic cell 7 for recommencement of the electrodeposition of high-purity metal thereon. Concurrently, the stripper assemblied 3 are returned from the second to the first position by the hydraulic cylinders 5 and held therein in preparation for the next cycle.

Figure 17:
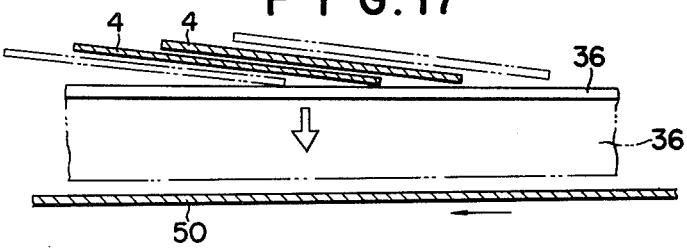
FIG. 17 is a fragmentary vertical section showing tumbled metal layers on a supporting plate and a conveyor therebelow.

When the cathode sheets 2 are hoisted and the stripper assemblies 3 retracted, only the stripper metal sheets 4 are left on the supporting plates 35 and 36 and topple over one another in the manner shown in FIG. 17 as soon as the cathode sheets 2 and the stripper assemblies 3 leave the space within the rack R.

Thereafter, the actuators 40 are operated to cause the supporting plates 35 and 36 to swing down to the vertical position as illustrarted by chain line in FIG. 17, whereby the toppled metal sheets 4 drop onto the surface of the conveyor 50 and are carried thereby away from the apparatus to a metal sheet stacking station not shown. When the supporting plates 35 and 36 are to be swung down, it is preferable that the pair of the plates 35*a* and 36*a* located downstream with respect to the conveying direction of the conveyor 50 be first caused to swing down to drop the metal sheets 4 placed thereon and thereafter the other pair of the opposing plates 35*a* and 36*a* is caused to swing down. Thus, it is possible to convey the metal sheets 4 to the stacking station in two batches.

Figure 18:
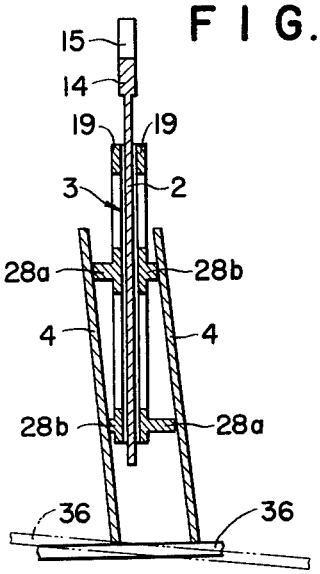
FIG. 18 is a view similar to FIG. 16, but showing a modified form of the stripper assembly.

To ensure that all of the stripped metal sheets 4 topple onto the supporting plates in the same direction as shown in FIG. 17, the ridges or protuberances 28 on the stripper plates 19 may be made different in height. More specifically, as shown in FIG. 18, the upper ridge 28*a* on one stripper plate 19 may be made greater in height than the lower ridge 28*b* on the same plate, while the upper ridge 28*b* on the other stripper plate 19 may be made smaller in height than the lower ridge 28*a* on the same plate. In this case the peeled metal sheets 4 will naturally take the attitude of inclination toward the downstream side of the conveyor 50. For attaining the same purpose, the supporting plates 35 and 36 may be inclined slightly toward the upstream side with respect to the conveying direction of the conveyor 50, as shown in chain line in FIG. 18. In the above cases, the stripper assembly 3 located at the most downstream side may be provided with a retaining rod 54 (FIGS. 3 and 4) extending in parallel with the surface of the assembly. The rod 54 serves to prevent the stripped metal sheet 4 from toppling before the assembly 3 retracts to the first position.

We claim:

1. Apparatus for stripping from cathode sheets high-purity metal layers deposited on the opposite faces of the sheets by electrolysis, comprising:

rack means for holding therein the cathode sheets with said metal layers deposited thereon in side-by-side relationship with predetermined spacings therebetween, said rack means having at least one open side;

a plurality of stripper assemblies each comprising a pair of stripper plates disposed in face-to-face arrangement with respect to each other and substantially in coplanar relationship to a respective one of the cathode sheets held in positions within said rack means, said stripper assemblies being movable along the planes of the respective cathode sheets between a first position confronting said open side of said rack means and a second position within said rack means; and means for moving said stripper assemblies between said first and said second positions, whereby upon movement of said stripper assemblies from said first to said second position, the metal layers are peeled off the opposite faces of each cathode sheet as the latter slides relative to the associated stripper assembly between the pair of stripper plates thereof.

2. The apparatus as claimed in claim 1, wherein said pairs of stripper plates are made of relatively rigid but suitably resilient material, and wherein the stripper plates of each pair are held in substantial contact with each other when in said first position.

3. The apparatus as claimed in claim 2, further comprising squeeze roll means disposed adjacent said open side of said rack means for pressing each pair of stripper plates against the associated cathode sheet as said stripper assemblies travel from said first toward said second position therepast.

4. The apparatus as claimed in claim 2, wherein each of said stripper assemblies has a pair of spread-apart lips projecting in the direction from said first to said second position from the respective stripper plates, whereby the cathode sheets are unfailingly caught between the respective pairs of stripper plates through said lips as said stripper assemblies start travelling from said first toward said second position.

5. The apparatus as claimed in claim 1, wherein said stripper assemblies have stripper blade portions formed at the side thereof, nearer to the rack means, of the respective stripper plates for engaging the metal layers and peeling the same off the cathode sheets as said stripper assemblies travel from said first to said second position.

6. The apparatus as claimed in claim 1, wherein said stripper assemblies have protuberances formed on the outer faces of the stripper plates for facilitating separation of the metal layers from the cathode sheets.

7. The apparatus as claimed in claim 6, wherein said protuberances are formed at higher and lower positions on each pair of the stripper plates, the protuberance at the higher position on one stripper plate being of greater height than that at the lower position on the same plate, the protuberance at the higher position on the other stripper plate being of less height then that at the lower position on the same plate.

8. The apparatus as claimed in claim 1, wherein said protuberances are each in the form of a ridge extending in the direction of movement of said stripper assemblies.

9. The apparatus as claimed in claim 1, further comprising positioning means secured to said rack means to engage said cathode sheets and precisely position the same within said rack means.

10. The apparatus as claimed in claim 1, further comprising means for preventing vibration of said cathode sheets immediately after the sheets are placed in said rack means, said means having a resilient roll movable into engagement with the cathode sheets.

11. The apparatus as claimed in claim 1, further comprising sheet supporting plate means provided in said rack means to support the cathode sheets thereon, said plate means normally taking a horizontal position and being capable of swinging down to a vertical position to allow said metal layers peeled off the cathode sheets to drop out of said rack means.

12. The apparatus as claimed in claim 11, further comprising conveyors means disposed below said rack means to receive thereon said peeled metal layers which drop out of the rack means and to convey the metal layers away from the apparatus.

13. The apparatus as claimed in claim 1, further comprising first spreader cam means fixed to said rack means to act on each of said pairs of stripper plates, as the plates are about to engage said cathode sheets, for causing each of said pairs to move apart from each other to facilitate engagement of the stripper plates with the cathode sheets without any interference therebetween.

14. The apparatus as claimed in claim 1, further comprising second spreader cam means fixed to said rack means to act on each of said pairs of stripper plates, when the plates have reached said second position, for causing each of said pairs to move away from the opposite faces of one of the cathode sheets to facilitate hoisting of the cathode sheets relative to the pairs of stripper plates.

15. Apparatus for stripping from a set of cathode sheets high-purity metal layers deposited on the opposite faces of each cathode sheets by electrolysis in an electrolytic cell, comprising:

rack means for holding therein the set of cathode sheets in side-by-side relationship with predetermined spacings therebetween, said rack means having an open top and at least one open side;

hoisting and transporting means for lifting the set of cathode sheets from the electrolytic cell after the metal layers have been deposited thereon to a desired thickness and for transporting and lowering the set of cathode sheets into said rack means through said open top;

a plurality of stripper assemblies each comprising a pair of stripper plates disposed in face-to-face arrangement with respect to each other and substantially in coplanar relationship to a respective one of the cathode sheets held in position within said rack means, said stripper assemblies being movable along the planes of the respective cathode sheets between a first position confronting said open side of said rack means and a second position within said rack means, said pairs of stripper plates being each adapted to make sliding contact with the opposite faces of the associated cathode sheet at least during the movement of said stripper assemblies from said first to said second position; and means for moving said stripper assemblies between said first and said second position, whereby upon movement of said stripper assemblies from said first to said second position, the metal layers are peeled off the opposite faces of each cathode sheet as the latter slides relative to the associated stripper assembly between the pair of stripper plates thereof.

16. The apparatus as claimed in claim 15, including drip receiving means provided in said rack means to receive liquid dripping from the set of cathode sheets which are being lowered into said rack means by said hoisting and transporting means.

17. The apparatus as claimed in claim 15, wherein said rack means, stripper assemblies and means for moving the stripper assemblies are mounted on a single framework movable relative to the electrolytic cell.

* * * * *